United States Patent [19]

Kightlinger

[11] 4,279,521

[45] Jul. 21, 1981

[54] WIRE MATRIX PRINT HEAD

[75] Inventor: Drew A. Kightlinger, Lexington, Ky.

[73] Assignee: International Business Machines Corporation, Armonk, N.Y.

[21] Appl. No.: 90,942

[22] Filed: Nov. 2, 1979

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,729,079 | 4/1973 | Zenner et al. | 400/124 |
| 3,893,220 | 7/1975 | Bittner | 400/124 X |
| 3,900,094 | 8/1975 | Larsen et al. | 400/124 |
| 3,904,011 | 9/1975 | Matschke | 400/124 |
| 4,060,161 | 11/1977 | Nelson et al. | 400/124 |
| 4,101,017 | 7/1978 | Englund et al. | 400/124 |
| 4,218,150 | 8/1980 | Swaim | 400/124 |

*Primary Examiner*—Paul T. Sewell

*Attorney, Agent, or Firm*—Frank C. Leach, Jr.

[57] ABSTRACT

A wire matrix print head has a first group of wires activated by a first group of electromagnetic means disposed on the circumference of a circle and substantially equally angularly spaced from each other. A second group of print wires is activated by a second group of electromagnetic means disposed on the circumference of a circle with each of the electromagnetic means of the second group having its longitudinal axis out of alignment with the longitudinal axis of each of the electromagnetic means of the first group. The print head includes guide means to transform the two groups of wires, which have their ends remote from the ends causing printing disposed on the circumferences of two circles, into a row and column matrix for causing printing.

4 Claims, 27 Drawing Figures

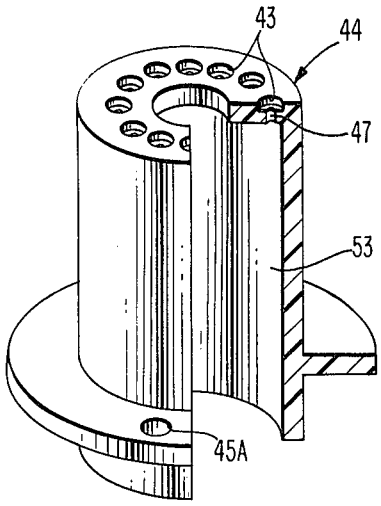
FIG. 5
FIG. 6
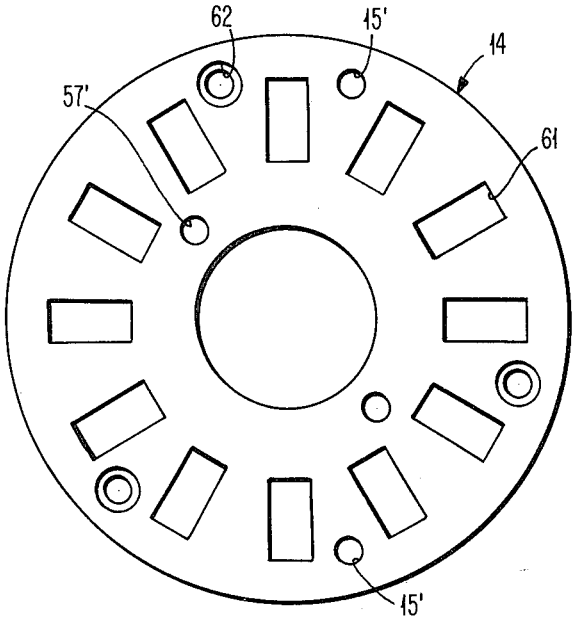
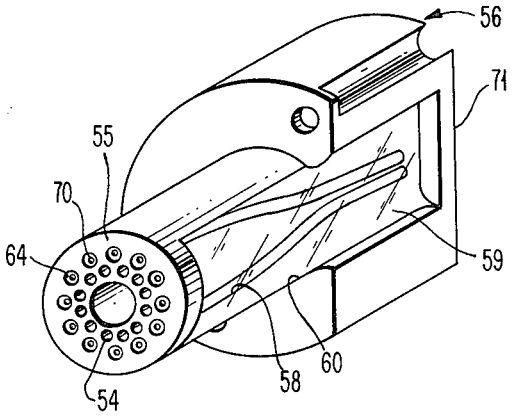
FIG. 7

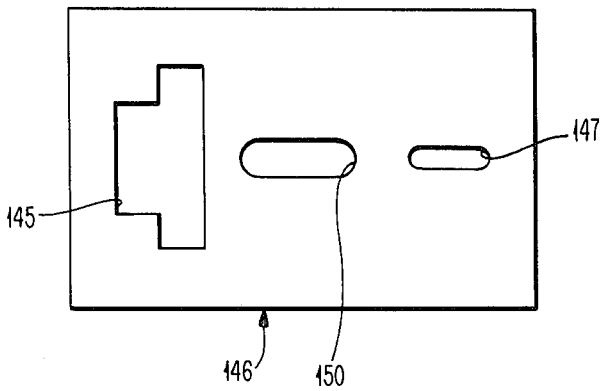
FIG. 21
FIG. 22
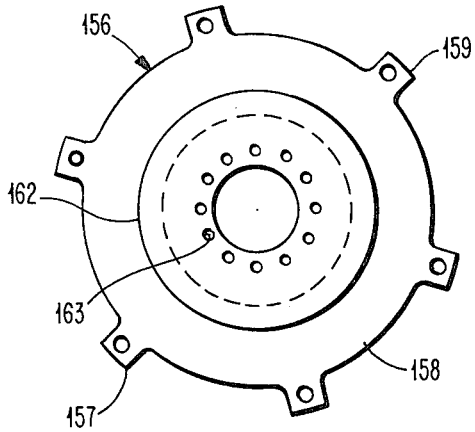
FIG. 23
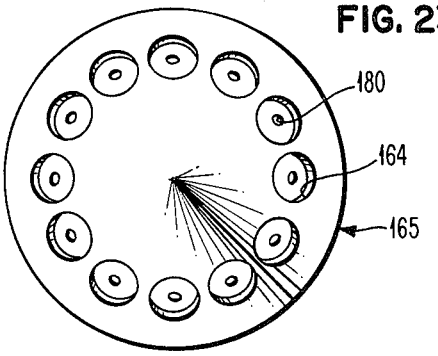

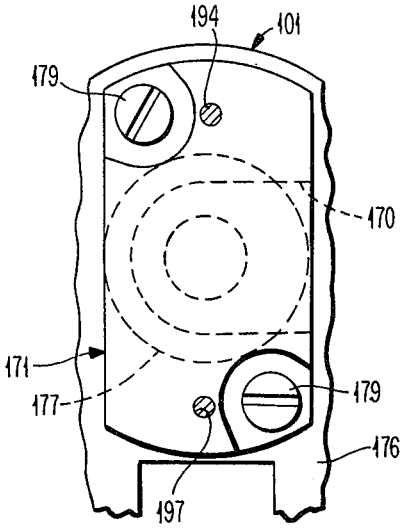
FIG. 24
FIG. 25
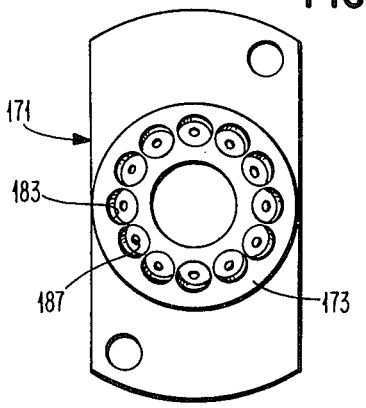
FIG. 26
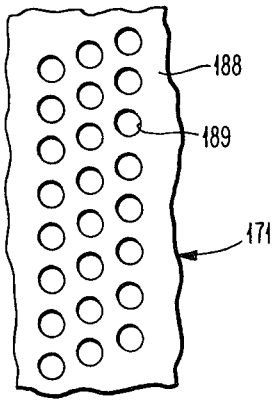

WIRE MATRIX PRINT HEAD

In a wire matrix printer, a plurality of wires is arranged to strike a recording medium to produce dots thereon through engaging a ribbon, for example. Each of the wires is normally activated by an electromagnetic means.

One problem with the previously available matrix wire printers has been that the number of wires has been limited. This is because of the necessity of arranging the electromagnetic means to activate the wires without causing too much bending of the wires or having the wires too long while still being able to activate each of the wires by one of the electromagnetic means.

It has previously been suggested to arrange a plurality of electromagnetic means about the circumference of a single circle. This requires the ends of the wires remote from the ends causing printing to be arranged on the circumference of a circle so as to be activated by one of the electromagnetic means. To obtain some type of matrix arrangement of the wires at the ends causing printing, the wires have previously been bent from their circular configuration to one or two columns. This requires bending of the wires so that the total number of wires is limited by both the size of each of the electromagnetic means and the bending per unit length of each of the wires.

Therefore, while arranging a plurality of electromagnetic means about the circumference of a single circle may produce print satisfactory for a cash register receipt, for example, this will not produce the relatively high quality print desired for a typewriter, for example, because of the lack of the desired overlapping of the dots produced on the recording medium by activation of the wires. To obtain overlapping dots of such high quality print as desired for a typewriter in a relatively short period of time, the previously suggested wire matrix printers would require more than one pass of a print head relative to the recording medium or incrementing of the recording medium.

Accordingly, either of these requirements is not desirable for a typewriter since it is desired that the print of each character occur during a single pass across the recording medium, which is paper, so that the typist is able to see the printed characters at any time and that the speed of printing be relatively fast. For example, if more than one pass is required to obtain a high quality print, the typist would not necessarily see a completed character. Additionally, incrementing of the recording medium would reduce the speed of printing.

Furthermore, increased quality character print is obtained by using wires of relatively small diameter. This enables more effective overlapping of the dots without having the edges of the characters give a ragged appearance so as to affect the print quality.

In the previously suggested wire matrix printers, it is necessary for the wire to be relatively stiff because of the relatively long length of at least some of the wires without support. The wires of the prior wire matrix printers have been of relatively large diameter to provide the stiffness necessary to prevent oscillations, which would occur with relatively thin wires without guides. Therefore, the previously suggested wire matrix printers having a plurality of electromagnetic means arranged on the circumference of a single circle have not produced the desired high quality print for use with a typewriter, for example.

It also has been previously suggested to form a wire matrix printer by arranging a pair of electromagnetic means at each of a plurality of spaced longitudinal distances. While this avoids the necessity of bending the wires, this has the disadvantage of the relatively large diameter wire being required to obtain the necessary stiffness. Thus, the desired high quality print of a typewriter is not obtainable with this type of wire matrix printer.

The present invention provides a wire matrix print head capable of providing high quality print for a typewriter, for example. The wire matrix print head of the present invention accomplishes this through providing a relatively large number of wires so as to have sufficient overlapping of the dots to print characters in one pass of relative movement between the print head and the recording medium. The wire matrix print head of the present invention is able to use wires substantially smaller than has previously been available because of the support provided to each of the wires. Thus, the relatively small dots, which are produced by the print wires of the wire matrix print head of the present invention, do not produce characters having a ragged edge as occurs for certain characters when relatively large dots overlap.

The wire matrix print head of the present invention produces a high quality print through having the electromagnetic means, which activate the print wires, in two groups spaced from each other with each group having the electromagnetic means arranged on the circumference of a circle. Each of the electromagnetic means of one group has its longitudinal axis out of alignment with the longitudinal axis of any of the electromagnetic means of the other group so that each of the wires activated by one of the electromagnetic means of the group farthest from the recording medium can pass between two of the wires activated by two of the electromagnetic means of the group closest to the recording medium. This reduces the bending of the wires.

The wire matrix print head of the present invention is relatively compact. Thus, it may be easily utilized with a movable carriage of a typewriter to print characters in response to activation of the keys of the typewriter. Because the wire matrix print head of the present invention is relatively compact, its moment of inertia is reduced with respect to the previously suggested wire matrix print head having pairs of the electromagnetic means spaced at longitudinal distances from the ends of the wires causing printing.

Through the utilization of the electromagnetic means on the circumference of two circles spaced longitudinally from each other, extensive bending of any of the wires to change the wires from a circular configuration to a row and column matrix is avoided. Thus, the wires of the wire matrix print head of the present invention have a relatively small amount of bending per unit length.

By having the wires with a relatively small amount of bending per unit length, the friction required to be overcome to move one of the wires is reduced. Thus, faster printing is obtained.

Through being able to use wires of substantially smaller diameter than previously employed in wire matrix print heads, the mass of the wire is reduced. The mass of the wire also is decreased because of the wires being shorter due to the arrangement of the two groups of electromagnetic means close to each other. With the wires having a reduced mass, the speed of the printing also can be increased.

Therefore, by reducing the mass of the wires and having the wires with a minimum bend per unit length, most of the input energy from the electromagnetic means is utilized for printing purposes. This enables faster printing speed.

An object of this invention is to provide a unique wire matrix print head.

Another object of this invention is to provide a compact matrix print head capable of producing high quality print.

A further object of this invention is to provide a wire matrix print head having particular utility in a typewriter.

Still another object of this invention is to provide a wire matrix print head capable of producing characters in a single pass of one of the print head and a recording medium relative to the other.

The foregoing and other objects, features, and advantages of the invention will be apparent from the following more particular description of the preferred embodiments of the invention, as illustrated in the accompanying drawings.

In the drawings:

FIG. 1 is a fragmentary longitudinal sectional view of one embodiment of the wire matrix print head of the present invention with one of the groups of the electromagnetic means shifted with respect to alignment with the other of the groups of the electromagnetic means for clarity purposes.

FIG. 5 is a perspective view, partly in section, of a rear wire guide of the wire matrix print head of FIG. 1.

FIG. 6 is a rear elevational view of a front mounting plate of the wire matrix print head of FIG. 1.

FIG. 7 is a perspective view of a nose piece of the wire matrix print head of FIG. 1 with only some passages shown for clarity purposes.

FIG. 21 is a top plan view of an inner guide for the armature of one of the electromagnetic means of the wire matrix print head of FIG. 13.

FIG. 22 is a front elevational view of a retainer plate of the wire matrix print head of FIG. 13 for gap adjusting screws.

FIG. 23 is a rear elevational view of a rear end cap of the wire matrix print head of FIG. 13.

FIG. 24 is a fragmentary front elevational view of a portion of the wire matrix print head of FIG. 13 without the wires and their openings and taken along line 24—24 of FIG. 13.

FIG. 25 is a rear elevational view of a portion of the nose piece of the wire matrix print head of FIG. 13.

FIG. 26 is an enlarged fragmentary view of a portion of the front wall of the nose piece of the wire matrix print head of FIG. 13 and showing the relationship of the passages for the print wires.

Figure 12:
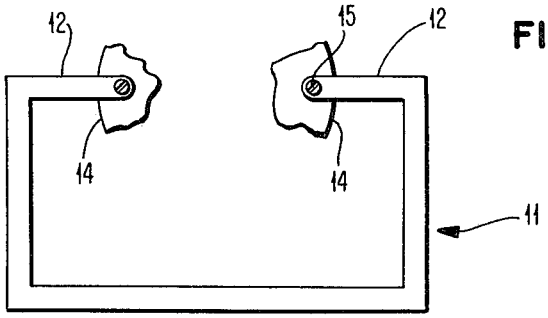
FIG. 12 is a fragmentary front elevational view showing the wire matrix print head of FIG. 1 mounted on a carriage.

Referring to the drawings and particularly FIG. 1, there is shown a wire matrix print head 10. The print head 10 is mounted on a carriage 11 (see FIG. 12) having a pair of ears 12 to which a front annular mounting plate 14 (see FIG. 1), which is metal, is connected by a pair of screws 15 (see FIG. 12) extending into a pair of threaded holes 15' (see FIG. 6) in the front mounting plate 14. The front mounting plate 14 is connected to a rear annular mounting plate 16 (see FIG. 1), which is metal, by a plurality (preferably three) of equally angularly spaced posts 17.

The front mounting plate 14 has a plurality of electromagnetic means 18 (only two shown in FIG. 1 for clarity purposes) supported thereon. The electromagnetic means 18 are equally angularly spaced from each other about the circumference of a circle. There are preferably twelve of the electromagnetic means 18 mounted on the front mounting plate 14 so that each of the electromagnetic means 18 has its longitudinal axis spaced 30° about the circumference of the circle from the next adjacent of the electromagnetic means 18.

The rear mounting plate 16 has a plurality of electromagnetic means 19 (only two shown in FIG. 1 for clarity purposes) mounted thereon on a circumference of a circle, which has the same diameter as the circle having the electromagnetic means 18 mounted on its circumference. Each of the electromagnetic means 19 is equally angularly spaced from each other. There are preferably twelve of the electromagnetic means 19 so that each is preferably spaced 30° from the next adjacent of the electromagnetic means 19.

The front mounting plate 14 and the rear mounting plate 16 are disposed relative to each other so that each of the electromagnetic means 18 has its longitudinal axis out of alignment with the longitudinal axis of any of the electromagnetic means 19. Each of the electromagnetic means 19 preferably has its longitudinal axis 15° from the longitudinal axis of two adjacent of the electromagnetic means 18.

Figure 2:
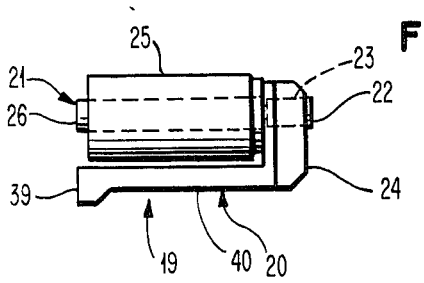
FIG. 2 is a side elevational view of one of the electromagnetic means of the wire matrix print head of FIG. 1.

Each of the electromagnetic means 19 includes an L-shaped yoke 20 having a core 21 connected thereto through a reduced cylindrical portion 22 (see FIG. 2) of the core 21 being hot upset within an opening 23 in a base 24 of the yoke 20. Prior to the core 21 being mounted on the yoke 20, a coil 25 is wound around a cylindrical portion 26 of the core 21.

Figure 3:
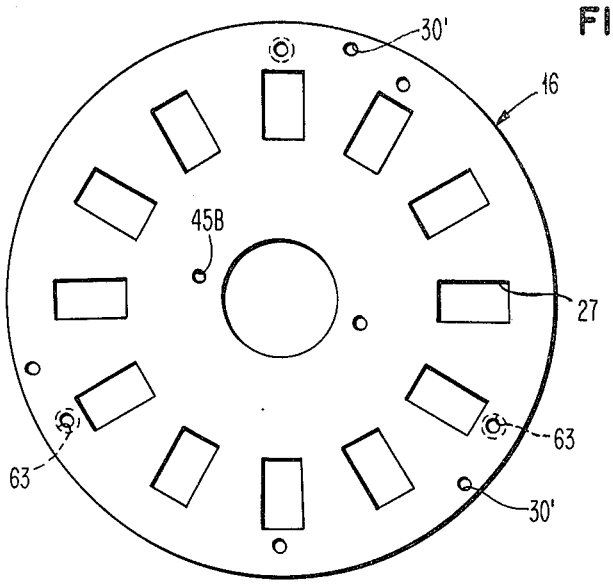
FIG. 3 is a rear elevational view of a rear mounting plate of the wire matrix print head of FIG. 1.
Figure 4:
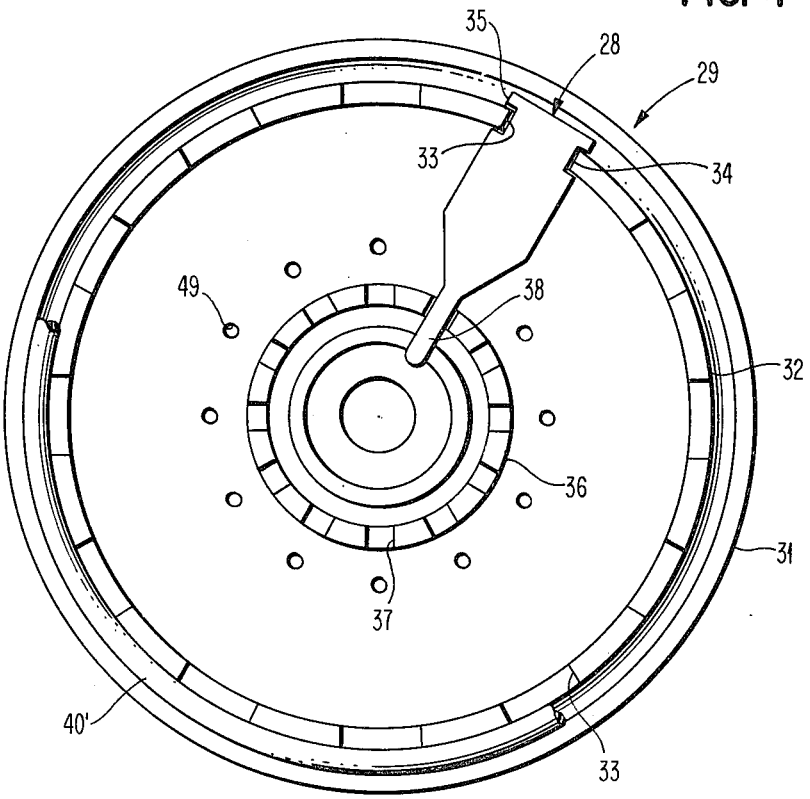

The base 24 of the yoke 20 is fitted within a rectangular shaped opening 27 (see FIG. 3) in the rear mounting plate 16 and retained therein by an adhesive epoxy. One suitable example of the adhesive epoxy is a transparent epoxy sold by Hardman, Inc., Belleville, Illinois.

Each of the electromagnetic means 19 (see FIG. 1) includes an armature 28, which is disposed within an annular retainer plate 29. The retainer plate 29 is formed of metal and secured to the rear mounting plate 16 by a plurality (preferably three) of springs 30 extending between openings 30' (see FIG. 3) in the rear mounting plate 16 and openings (not shown) in an outer rim 31 (see FIG. 4) of the retainer plate 29, which has an intermediate circular rim 32.

Figure 4:
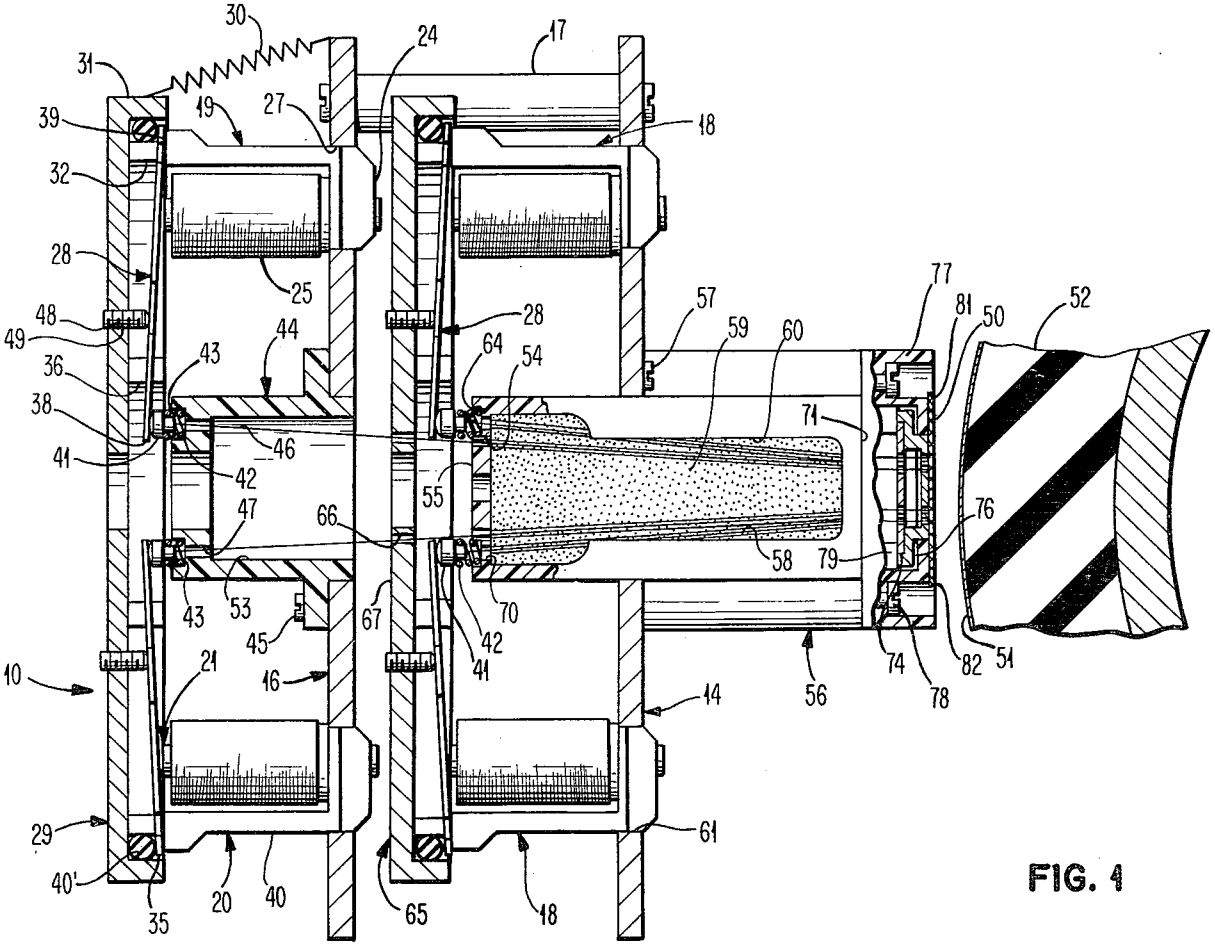
FIG. 4 is a front elevational view of a rear armature retainer plate of the wire matrix print head of FIG. 1 with one armature supported therein.

The intermediate rim 32, which has a greater height than the outer rim 31, has a plurality of cut out portions 33 equal in number to the number of the armatures 28. Each of the cut out portions 33 in the intermediate rim 32 receives a reduced portion 34 of one of the armatures 28 so that a portion 35 of the armature 28 is disposed between the intermediate rim 32 and the outer rim 31 as shown in FIG. 4 for one of the armatures 28.

The retainer plate 29 has an inner circular rim 36 of substantially smaller diameter than the diameter of the intermediate rim 32 and of substantially the same height as the outer rim 31. The inner rim 36 has a plurality of cut out portions 37, which are equal to the number of the cut out portions 33 and the number of the armatures 28, so as to receive a narrow finger 38 of the armature 28 therein. Each of the cut out portions 37 is on the same radius as one of the cut out portions 33.

When the armature retainer plate 29 is held in position by the springs 30 to the rear mounting plate 16, each of the yokes 20 has an end 39 (see FIG. 2) of its arm 40 disposed in one of the cut out portions 33 (see FIG. 4) in the intermediate rim 32 of the armature retainer plate 29 to engage the reduced portion 34 of the armature 28 therein. The end 39 (see FIG. 2) of the arm 40 of the yoke 20 also bears against most of the end portion 35 (see FIG. 4) of the armature 28 between the outer rim 31 and the intermediate rim 32.

An O-ring 40' (see FIG. 1) is disposed between the outer rim 31 and the intermediate rim 32 and has the end portion 35 of the armature 28 bearing thereagainst. The O-ring 40' holds the end portion 35 of the armature 28 against the end 39 (see FIG. 2) of the arm 40 of the yoke 20.

The narrow finger 38 (see FIG. 4) of the armature 28 has a wire cap 41 (see FIG. 1) urged thereagainst by a spring 42. The spring 42 is disposed within a recess 43 in a rear wire guide 44, which is preferably formed of a plastic such as Delrin and is secured to the rear mounting plate 16 by a pair of screws 45 extending through diametrically disposed holes 45A (see FIG. 5) in the rear wire guide 44 into threaded holes 45B (see FIG. 3) in the rear mounting plate 16.

Each of the wire caps 41 (see FIG. 1) has a print wire 46 secured thereto. The print wire 46, which preferably has a diameter of 0.008" ($1.932\times10^{-2}$ cm), is preferably formed of tungsten rhenium. The print wire 46 extends through a passage 47 in the rear wire guide 44 from the recess 43.

Each of the armatures 28 has a set screw 48, which is carried in a threaded hole 49 (see FIG. 4) in the armature retaining plate 29, acting thereon to adjust the gap between the armature 28 and the core 21 (see FIG. 1). The set screw 48 also places the desired preload on the spring 42 at the same time. The set screw 48 has a piece of energy absorbing rubber on its end so that the set screw 48 also functions as a damper when the armature 28 is returned to the position of FIG. 1 when the coil 25 is deenergized.

Thus, when the coil 25 of one of the electromagnetic means 19 is energized, the armature 28 pivots about the end 39 of the arm 40 of the yoke 20 to move the wire cap 41 against the force of the spring 42. This movement of the wire cap 41 causes the connected wire 46 to engage a ribbon 50 to urge it against a recording medium 51, which is paper, for example, to cause printing on the recording medium 51.

The recording medium 51 is supported by a platen 52 in the well-known manner of a typewriter on the side of the recording medium 51 away from the ribbon 50. Thus, the recording medium 51 is incremented relative to a printing line position by rotation of the platen 52 at the end of each pass of the wire matrix print head 10 relative to the recording medium 51.

The rear wire guide 44 has an enlarged cylindrical shaped chamber 53 of constant diameter therein communicating with each of the passages 47 therein. Thus, the print wires 46 enter the chamber 53 from the passages 47 without any substantial bending.

Each of the wires 46 extends from the chamber 53 in the rear wire guide 44 through a passage 54 (see FIG. 7) in a rear wall 55 of a nose piece 56, which is preferably formed of a plastic such as Delrin and is secured to the front mounting plate 14 (see FIG. 1) by a pair of screws 57 extending into a pair of diametrically disposed threaded holes 57' (see FIG. 6) in the front mounting plate 14. Each of the wires 46 (see FIG. 1) extends through the passage 54 in the rear wall 55 of the nose piece 56 into a passage 58 in a potting compound 59, which is in a cavity 60 in the nose piece 56 and functions as a guide means for each of the wires 46.

Each of the electromagnetic means 18 is similar to each of the electromagnetic means 19 but has the yoke 20 mounted on the front mounting plate 14 through being disposed in a rectangular shaped opening 61 (see FIG. 6) in the front mounting plate 14. As previously mentioned, the longitudinal axis of each of the electromagnetic means 18 is not aligned with the longitudinal axis of any of the electromagnetic means 19. This is accomplished through disposing recesses 62 in the front mounting plate 14 half way between radii passing through the center of each of three adjacent pair of the openings 61. Each of the recesses 62 receives one end of the post 17 (see FIG. 1). The rear mounting plate 16 (see FIG. 3) has recesses 63 for an end of each of the posts 17 (see FIG. 1) formed on the same radii as the center of each of three of the openings 27, which are spaced 120° from each other. Thus, this arrangement results in the connection of the plates 14 (see FIG. 1) and 16 to each other by the posts 17 offsetting the longitudinal axis of each of the electromagnetic means 18 from the longitudinal axis of each of the electromagnetic means 19 by 15°. These are not so shown in FIG. 1 but are shown aligned for clarity purposes.

The rear wall 55 of the nose piece 56 has a plurality of equally angularly spaced recesses 64 (see FIG. 7) formed about the circumference of a circle. Each of the recesses 64 has its center on a radius offset 15° from a radius passing through the center of one of the passages 54. Each of the recesses 64 receives one of the springs 42 (see FIG. 1), which bias the wire caps 41 against the armatures 28 of the electromagnetic means 18.

The armatures 28 of the electromagnetic means 18 are retained in a front armature retainer plate 65. The front armature retainer plate 65 is secured to the front mounting plate 14 by springs (not shown) in the same manner as the springs 30 connect the rear armature retaining plate 29 to the rear mounting plate 16.

The front armature retainer plate 65 is similar to the rear armature retainer plate 29. However, the front armature retainer plate 65 has a plurality of passages 66 (see FIG. 8) in its end wall 67 to receive the twelve print wires 46 (see FIG. 1), which are activated by the electromagnetic means 19. Thus, each of the wires 46 which are activated by the electromagnetic means 19 passes through one of the passages 66 in the front armature retainer plate 65 prior to entering the passage 54 in the rear wall 55 of the nose piece 56.

Figure 8:
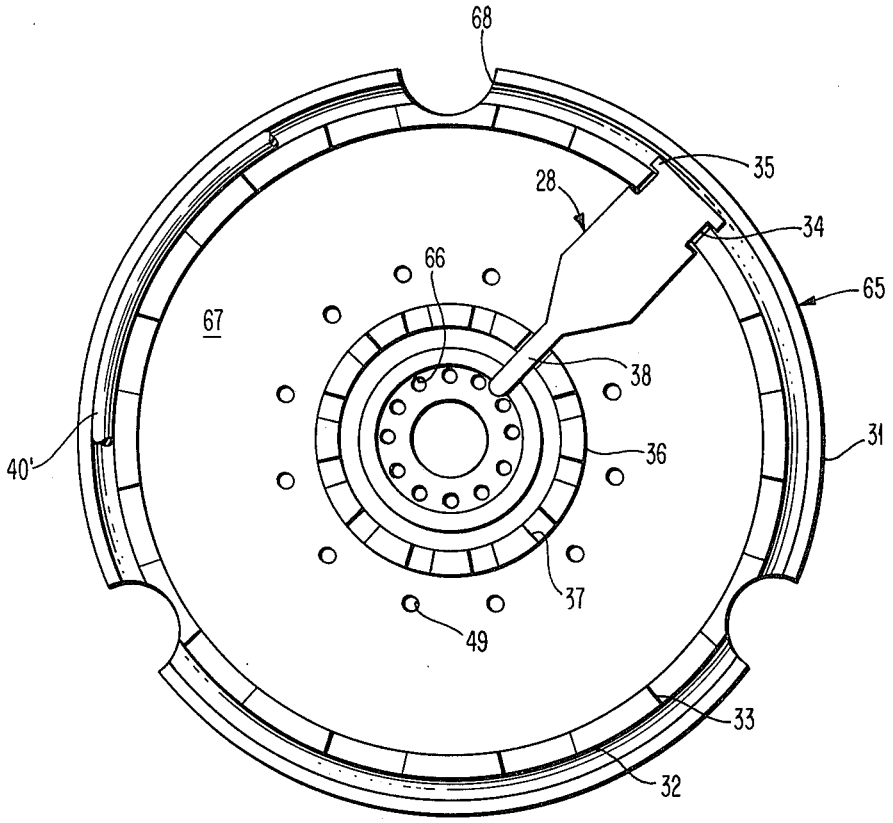
FIG. 8 is a front elevational view of a front armature retainer plate of the wire matrix print head of FIG. 1 with one armature supported therein.

As shown in FIG. 8, the passages 66 are disposed on radii extending from the centers of the front armature retainer plate 65 and offset 15° from adjacent radii extending along the centers of the cut out portions 33 and 37 in the rear armature retainer plate 65. Thus, the narrow finger 38 of each of the armatures 28 passes between two of the passages 66 in the front retainer plate 65 as shown in FIG. 8.

Another difference between the front armature retainer plate 65 and the rear armature retainer plate 29 (see FIG. 1) is that the front armature retainer plate 65 has a plurality of cut out portions 68 (see FIG. 8) in its end wall 67 to accommodate the posts 17 (see FIG. 1), which connect the front annular plate 14 and the rear annular plate 16 to each other. Each of the cut out portions 68 (see FIG. 8) extends into the intermediate rim 32 between two of the cut out portions 33.

Each of the wires 46 (see FIG. 1), which is activated by one of the electromagnetic means 18, extends from the recess 64 in the rear wall 55 of the nose piece 56 through a passage 70 in the rear wall 55 of the nose piece 56 into one of the passages 58 in the potting compound 59, which is within the cavity 60 in the nose piece 56. Thus, each of the wires 46, which is activated by one of the electromagnetic means 18, is guided by one of the passages 58.

The nose piece 56 has a front wall 71 at the front of the cavity 60 with a plurality of passages 72 (see FIG. 10) therein providing communication from the cavity 60 (see FIG. 1) to the exterior of the front of the nose piece 56. Thus, the passages 72 (see FIG. 10) enable each of the print wires 46 (see FIG. 1) to pass from one of the passages 58 in the potting compound 59 to the exterior of the nose piece 56 to engage the ribbon 50 when the electromagnetic means 18 or 19, which activates the print wire 46, is activated to cause this movement.

Figure 10:
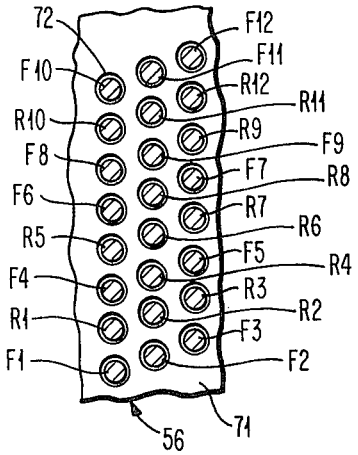
FIG. 10 is a front elevational view of a portion of the nose piece of FIG. 7 and showing the relationship of all of the printing ends of the print wires of the wire matrix print head of FIG. 1.

The passages 72 (see FIG. 10) in the front wall 71 of the nose piece 56 are arranged in three columns of eight. Furthermore, the passages 72 are staggered in each of the columns relative to the next column as shown in FIG. 10 for the wires 46.

The wires 46 in the second column have their centers spaced vertically 0.005" ($1.27\times10^{-2}$ cm) from the centers of the wires 46 in the first column. The centers of the wires 46 in the third column are spaced 0.005" ($1.27\times10^{-2}$ cm) vertically from the centers in the second column. Since the distance between the centers of two of the wires 46 in the same column is 0.015" ($3.81\times10^{-2}$ cm), then the shortest vertical distance from the center of one of the wires 46 in the third column to the center of one of the wires in the first column is 0.005" ($1.27\times10^{-2}$ cm).

With each of the wires 46 having a diameter of 0.008" ($1.932\times10^{-2}$ cm), each of the dots produced on the recording medium 51 (see FIG. 1) by the wire 46 engaging the ribbon 50 is 0.010" ($2.54\times10^{-2}$ cm) because of the spreading of the material of the ribbon 50 by the wire 46 pushing the ribbon 50 against the recording medium 51. Thus, with each of the dots having a diameter of 0.010" ($2.54\times10^{-2}$ cm), dots produced on the recording medium 51 by the bottom wire 46 of the wires 46, for example, in each of the two adjacent columns produces two overlapping dots in which the circumference of each of the two dots passes through the center of the other of the two dots.

Therefore, the wire matrix print head 10 is incremented in the pass or horizontal direction 0.005" ($1.27\times10^{-2}$ cm) at a time and then momentarily stopped or on the fly to cause printing. Accordingly, overlapping dots produced at the same horizontal position on the recording medium 51 from the bottom wire 46 of the wires 46 in each of two adjacent columns occur at the first and fourth time intervals, for example, of incrementing. That is, the wire 46 in one of the trailing columns does not strike the same horizontal position on the recording medium 51 that the wire 46 in the next of the leading columns strikes until there have been three increments of the wire matrix print head 10 in the horizontal or pass direction of 0.005" ($1.27\times10^{-2}$ cm).

Figure 9:
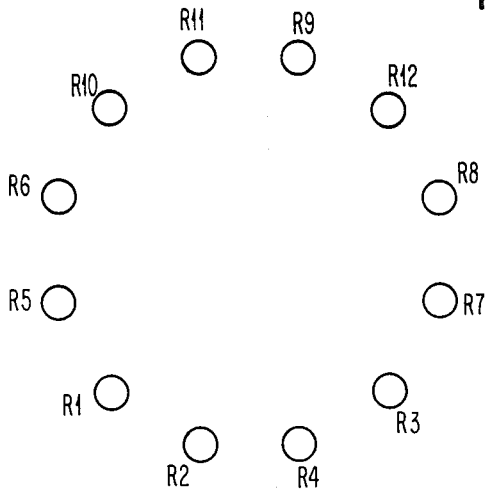
FIG. 9 is a schematic view showing the positions of various print wires around a circumference of a circle for activation by the electromagnetic means mounted on the rear mounting plate of the wire matrix print head of FIG. 1.
Figure 11:
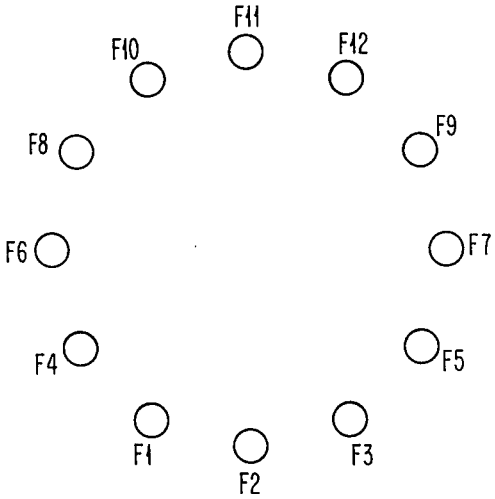
FIG. 11 is a schematic view showing the positioning of various print wires around a circumference of a circle for activation by the electromagnetic means mounted on the front mounting plate of the wire matrix print head of FIG. 1.

The location of each of the wires 46 in one of the passages 47 in the rear wire guide 44 for the wires 46 activated by the electromagnetic means 19 are identified in FIG. 9 as R1 through R12 with these same twelve print wires 46 being shown in FIG. 10 when they exit through the passages 72 in the front wall 71 of the nose piece 56. The wires 46, which are activated by the electromagnetic means 18 (see FIG. 1), have their positions shown on the circumference of a circle in FIG. 11 at the time that they enter the passages 70 (see FIG. 1) in the rear wall 55 of the nose piece 56 and are identified as F1 through F12. These same twelve wires 46 are similarly identified in FIG. 10 as they exit through the passages 72 in the front wall 71 of the nose piece 56.

The potting compound 59 (see FIG. 1) is formed within the cavity 60 in the nose piece 56 through initially disposing the nose piece 56 and the rear wire guide 44 in fixtures in the positions in which they would be disposed at the time of completion of assembly of the wire matrix print head 10. Then, twelve guide wires, which have a diameter of 0.011" ($2.794\times10^{-2}$ cm), are disposed in each of the passages 72 (see FIG. 10) in the front wall 71 of the nose piece 56 corresponding to the location of each of the wires 46, identified as F1 through F12 in FIG. 10, and extend through the cavity 60 (see FIG. 1) into the passages 70. Twelve additional guide wires, which also have a diameter of 0.011" ($2.794\times10^{-2}$ cm), are placed in each of the passages 72 (see FIG. 10) in the front wall 71 of the nose piece 56 corresponding to the location of each of the wires 46, identified as R1 through R12 in FIG. 10, and extend through the cavity 60 (see FIG. 1), the passages 54 in the rear wall 55 of the nose piece 56, the chamber 53, and the passages 47 in the rear wire guide 44. The passages 47, 54, and 72 are the same size as the guide wires inserted therein.

Then, the epoxy potting compound 59 is formed within the cavity 60 in the nose piece 56. It should be understood that the cavity 60 is positioned in the fixtures so as to have its open portion facing upwardly.

One suitable example of the epoxy potting compound 59 is a clear resin and its curing agent sold by Conap, Incorporated, Olean, N.Y. with the resin being Conepoxy RN 100 and the curing agent being Conacure EA-02. The epoxy potting compound 59, which is formed by one hundred parts by weight of the resin and eleven parts by weight of the curing agent, is cured at an ambient temperature of 68° F. to 72° F. for twenty-four hours.

Next, the nose piece 56 and the rear wire guide 44 are heated to a temperature in the range of 150° to 225° F., preferably 200° F., to cause more expansion of the potting compound 59, the rear wire guide 44, and the nose piece 56 than the guide wires since the guide wires are metal and have a smaller coefficient of expansion. This enables the guide wires to be removed. As a result, the passages 58 are formed in the potting compound 59 and are of larger diameter than the wires 46, which are preferably 0.008" ($1.932\times10^{-2}$ cm) in diameter as previously mentioned. Air cooling of the rear wire guide 44 and the nose piece 56 next occurs.

Accordingly, a minimum bending per unit length of each of the wires 46 occurs. Furthermore, there is support for each of the wires 46 throughout the potting compound 59 in the nose piece 56. Thus, the wires 46 are guided by the potting compound 59 to the desired passage 72 (see FIG. 10) in the front wall 71 of the nose piece 56.

Figure 27:
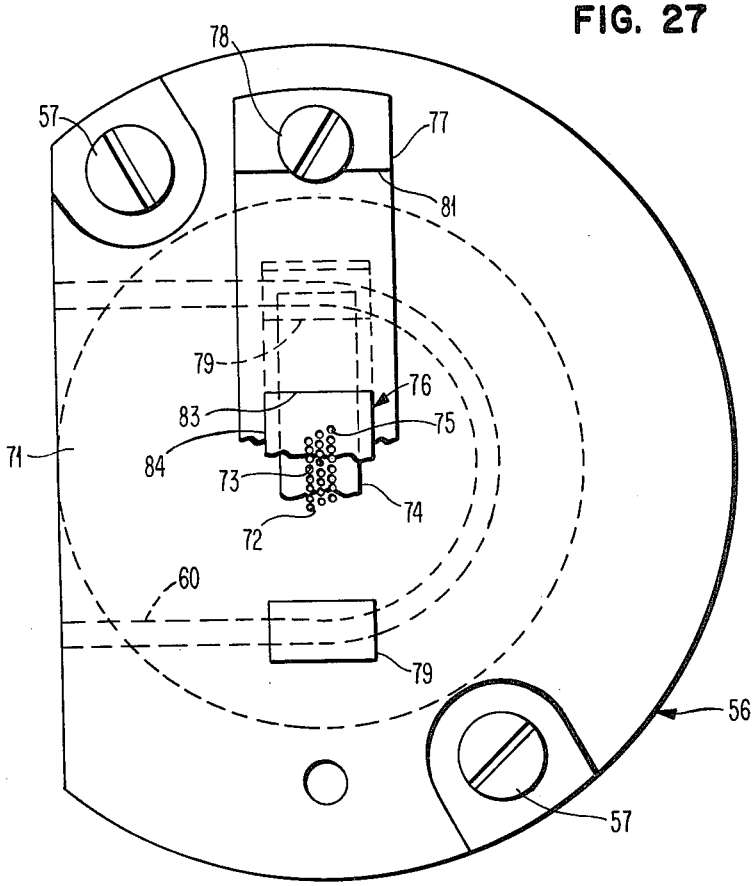
FIG. 27 is an end elevational view of the nose piece of FIG. 7.

After each of the wires 46 exits from the passage 72 in the front wall 71 of the nose piece 56, each of the wires 46 passes through an aligned passage 73 (see FIG. 27) in a first metal head guide 74 and an aligned passage 75 in a second metal head guide 76. The head guides 74 and 76 are retained in position by a guide retainer 77, which is secured by a pair of screws 78 to the nose piece 56. The inner surface of the head guide 74 is held against a pair of substantially parallel projections 79 outwardly extending from the front wall 71 of the nose piece 56.

The guide retainer 77 provides a pair of parallel surfaces 81 and 82 (see FIG. 1) to guide the ribbon 50 during its movement past the print head 10. Thus, upward movement of the ribbon 50 is limited by the surface 81, and downward movement of the ribbon 50 is limited by the surface 82.

The guide retainer 77 has a rectangular shaped opening 83 (see FIG. 27) into which a protruding portion 84, which has the passages 75 of the head guide 76, extends. This allows the wires 46 (see FIG. 1) to be disposed adjacent the ribbon 50.

Figure 13:
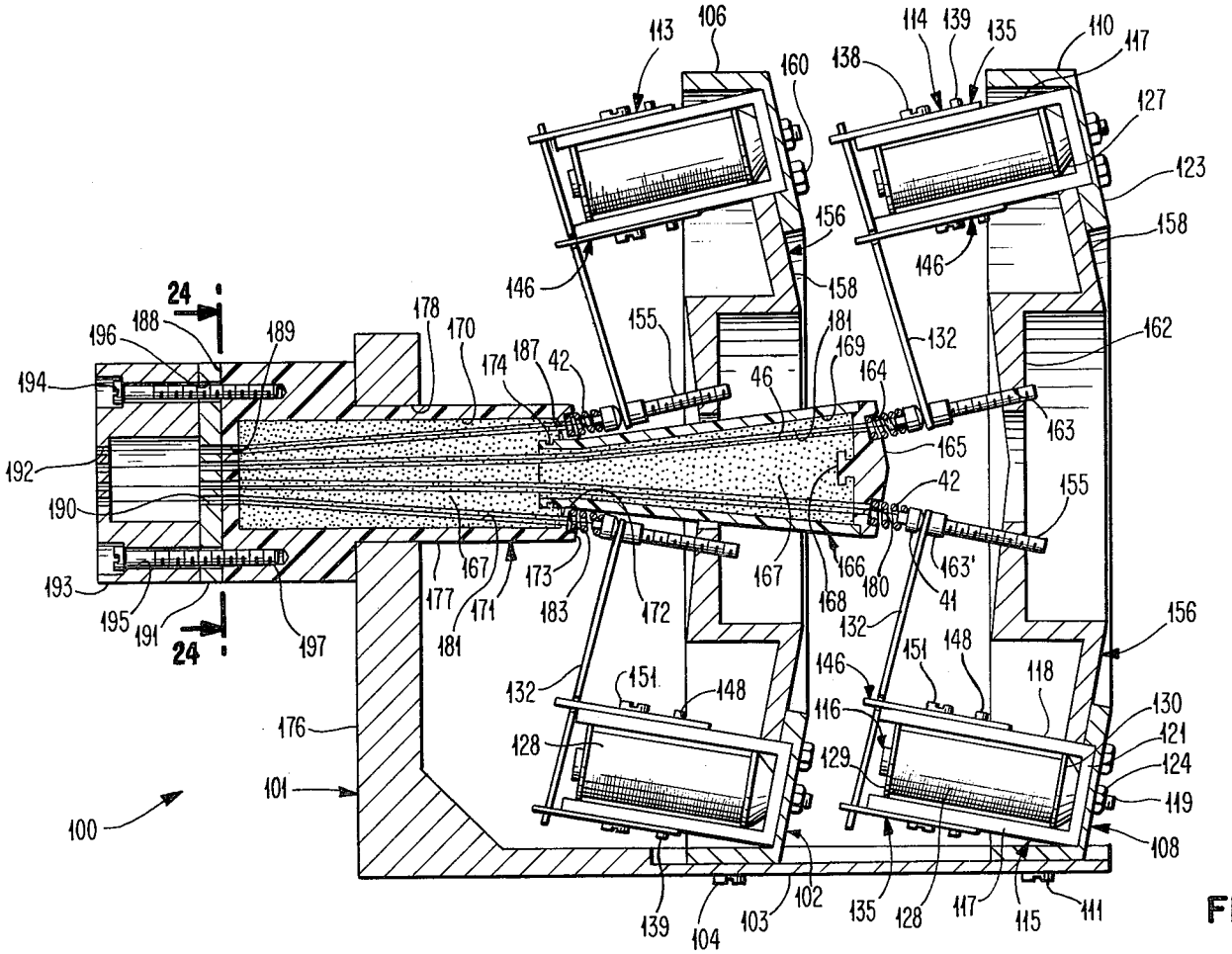
FIG. 13 is a fragmentary longitudinal sectional view of another form of the wire matrix print head of the present invention with one of the groups of the electromagnetic means shifted with respect to alignment with the other of the groups of the electromagnetic means for clarity purposes.

Referring to FIG. 13, there is shown a wire matrix head 100. The wire matrix head 100 includes a stand 101, which can be mounted on the carriage 11 (see FIG. 12).

Figure 14:
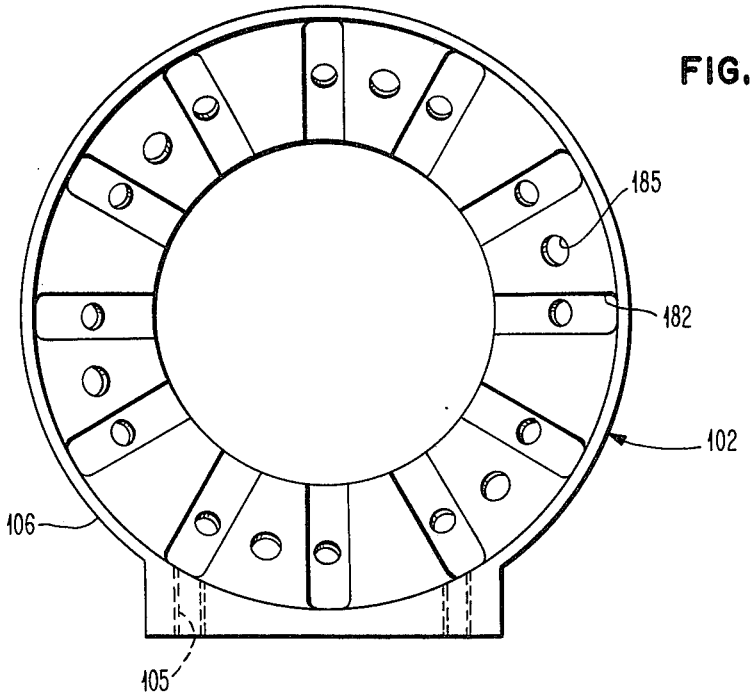
FIG. 14 is a front elevational view of a front mounting plate of the wire matrix print head of FIG. 13.
Figure 15:
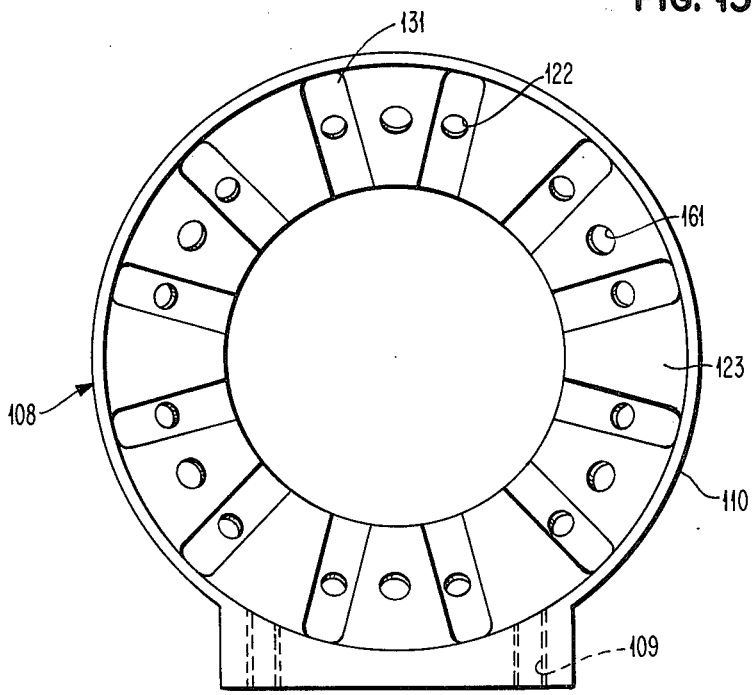
FIG. 15 is a front elevational view of a rear mounting plate of the wire matrix print head of FIG. 13.

The stand 101 (see FIG. 13) has a front annular mounting plate 102, which is metal, connected to its base 103, which would be supported on the carriage 11 (see FIG. 12), by screws 104 extending into threaded holes 105 (see FIG. 14) in an enlarged portion of an outer rim or flange 106 of the front mounting plate 102 after passing through holes (not shown) in the base 103 (see FIG. 13) of the stand 101. A rear annular mounting plate 108, which is metal, is disposed on the base 103 of the stand 101 in spaced longitudinal relation to the front mounting plate 102. The rear mounting plate 108 has threaded holes 109 (see FIG. 15) in an enlarged portion of an outer rim or flange 110 to receive screws 111, which pass through holes (not shown) in the base 103 (see FIG. 13) for the stand 101. Thus, the mounting plates 102 and 108 are spaced a fixed longitudinal distance from each other.

The front mounting plate 102 has a plurality of electromagnetic means 113 supported thereon. The electromagnetic means 113 are equally angularly spaced from each other about the circumference of a circle having the center of the front mounting plate 102 as its center. There are preferably twelve of the electromagnetic means 113 mounted on the front mounting plate 102 so that each of the electromagnetic means 113 has its longitudinal axis spaced 30° about the circumference of the circle from the next adjacent of the electromagnetic means 113.

The rear mounting plate 108 has a plurality of electromagnetic means 114 mounted thereon on a circumference of a circle, which has a diameter slightly smaller than the diameter of the circle having the electromagnetic means 113 mounted on its circumference and has the center of the rear mounting plate 108 as its center. Each of the electromagnetic means 114 is equally angularly spaced from each other. There are preferably twelve of the electromagnetic means 114 so that each is preferably spaced 30° from the next adjacent of the electromagnetic means 114.

The mounting plates 102 and 104 have the electromagnetic means 113 and 114, respectively, mounted thereon so that each of the electromagnetic means 113 has its longitudinal axis out of alignment with the longitudinal axis of any of the electromagnetic means 114. Each of the electromagnetic means 114 preferably has its longitudinal axis 15° from the longitudinal axis of each of two adjacent of the electromagnetic means 113.

Figure 16:
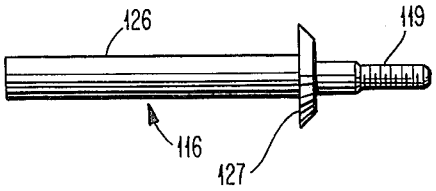
FIG. 16 is a side elevational view of a core of one of the electromagnetic means of the wire matrix print head of FIG. 13.
Figure 18:
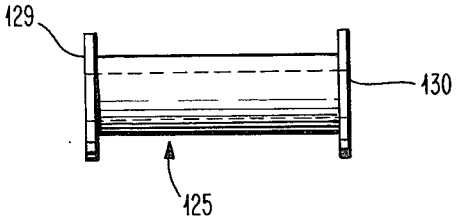
FIG. 18 is a side elevational view of a bobbin of one of the electromagnetic means of the wire matrix print head of FIG. 13 and on which a coil is wound.
Figure 17:
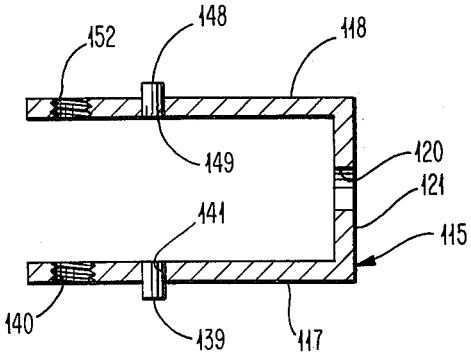
FIG. 17 is a sectional view of a yoke of one of the electromagnetic means of the wire matrix print head of FIG. 13.

Each of the electromagnetic means 114 includes a U-shaped yoke 115 having a core 116 disposed between substantially parallel legs 117 and 118 of the yoke 115. The core 116 and the yoke 115 are connected to each other and to the rear mounting plate 108 through a threaded stud 119 (see FIG. 16) on the end of the core 116 extending through an opening 120 (see FIG. 17) in a base 121 of the yoke 115 and an opening 122 (see FIG. 15) in an inclined end wall 123 of the rear mounting plate 108 with a nut 124 (see FIG. 13) secured to the threaded stud 119 (see FIG. 16). Prior to the core 116 being connected to the yoke 115 (see FIG. 17) and the rear mounting plate 108 (see FIG. 15), a bobbin 125 (see FIG. 18) is mounted on a cylindrical portion 126 (see FIG. 16) of the core 116 and abuts a stop 127 at the end of the cylindrical portion 126. A coil 128 (see FIG. 13) is wound around the bobbin 125 (see FIG. 18) between flanges 129 and 130 thereon.

The base 121 (see FIG. 17) of the yoke 115 is disposed in a recess 131 (see FIG. 15) in the end wall 123 of the rear mounting plate 100. Each of the recesses 131 has the opening 122 therein.

The center lines of the recesses 131 are spaced 30° from each other about the circumference of a circle having the center of the rear mounting plate 108 as its center and are radii of the circle. Thus, the locations of the recesses 131 insure that the electromagnetic means 114 (see FIG. 13) are equally angularly spaced from each other.

The end wall 123 of the rear mounting plate 108 is inclined 12° to the vertical. Thus, with the flange 110 disposed in the horizontal plane, the end wall 123 of the rear mounting plate 108 is at an angle of 102° to the flange 110. Therefore, the longitudinal axis of each of the electromagnetic means 114 is disposed at an angle of 12° to the horizontal. This results in the print wire 46 having less bending than is required by the wire matrix print head 10 of FIG. 1 so that each of the wires 46 can be slightly thinner such as 0.007" ($1.778\times10^{-2}$ cm) in diameter, for example.

Figure 19:
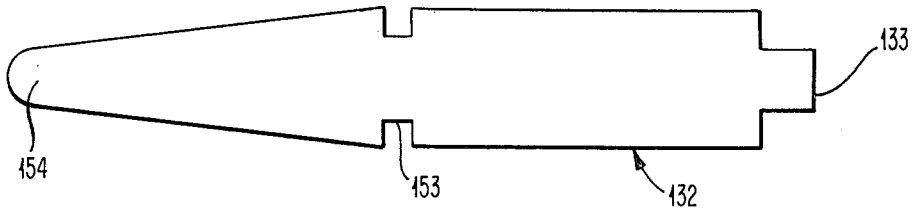
FIG. 19 is a top plan view of an armature of one of the electromagnetic means of the wire matrix print head of FIG. 13.
Figure 20:
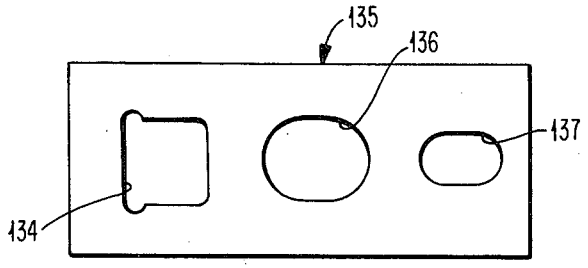
FIG. 20 is a top plan view of an outer guide for the armature of one of the electromagnetic means of the wire matrix print head of FIG. 13.

Each of the electromagnetic means 114 includes an armature 132, which has its reduced outer end 133 (see FIG. 19) disposed in an opening 134 (see FIG. 20) of an outer guide 135, which is adjustably mounted on the outer leg 117 (see FIG. 17) of the U-shaped yoke 115. The guide 135 (see FIG. 20), which is a thin plate formed of a suitable plastic such as Delrin, for example, has an egg shaped slot 136 (see FIG. 20) and an elongated slot 137 to receive a screw 138 (see FIG. 13) and a pin 139, respectively. The screw 138 extends into a threaded hole 140 (see FIG. 17) in the outer leg 117 of the U-shaped yoke 115 while the pin 139 is press fitted into a hole 141 in the outer leg 117 of the U-shaped yoke 115. The adjustment of the guide 135 (see FIG. 13) relative to the U-shaped yoke 115 on which it is mounted controls the air gap between the end of the core 116 and the armature 132.

The armature 132 extends through a T-shaped slot 145 (see FIG. 21) in an inner guide 146, which is mounted on the inner leg 118 (see FIG. 13) of the U-shaped yoke 115. The guide 146, which is a thin plate formed of a suitable plastic such as Delrin, for example, has an elongated slot 147 (see FIG. 21) to receive a pin 148 (see FIG. 17), which is press fitted in a hole 149 in the inner leg 118 of the U-shaped yoke 115.

The guide 146 (see FIG. 21) has a second elongated slot 150 between the slot 147 and the T-shaped slot 145 to receive a screw 151 (see FIG. 13), which also extends through a threaded hole 152 (see FIG. 17) in the inner leg 118 of the U-shaped yoke 115. Thus, the inner guide 146 (see FIG. 13) is adjustably positioned on the inner leg 118 of the U-shaped yoke 115.

Because of the position of the end of the inner leg 118 of the U-shaped yoke 115, the armature 132 has a reduced intermediate portion 153 (see FIG. 19) always maintained within the base of the T-shaped slot 145 (see FIG. 21) in the guide 146 irrespective of whether the coil 128 (see FIG. 13) is energized or not. The end of the outer leg 117 of the U-shaped yoke 115 holds the outer end 133 (see FIG. 19) on the armature 132 in the reduced portion of the slot 134 (see FIG. 20) in the outer guide 135 when the coil 128 (see FIG. 13) is energized.

The armature 132 (see FIG. 19) has a finger 154 extending from the reduced intermediate portion 153 and disposed between the end of the wire cap 41 (see FIG. 13) on one of the print wires 46 and a set screw 155, which functions as a return damper. The set screw 115 is mounted in an annular retainer plate 156, which has six equally angularly spaced ears 157 (see FIG. 22) at its circumference for mounting the retainer plate 156, which is metal, to the rear mounting plate 108 (see FIG. 13). The retainer plate 156 has its end wall 158, which the ears 157 are extensions thereof, inclined 12° to the vertical so that the ears 157 are inclined 12° to the vertical.

Each of the ears 157 (see FIG. 22) has a threaded hole 159 to receive a screw 160 (see FIG. 13), which also extends through a hole 161 (see FIG. 15) in the end wall 123 of the rear mounting plate 108. The centers of the holes 161 are disposed on the circumference of the same circle as the centers of the holes 122.

The retainer plate 156 (see FIG. 22) has a central portion 162 within which are disposed threaded holes 163 for the set screws 155 (see FIG. 13). Each of the set screws 155 has a coating 163' molded on its head of a suitable material with a suitable hardness to dampen motion of the armature 132 when it returns to its rest position after the coil 128 is deenergized. One suitable example of the coating 163' is a plastic sold as Monothane A-60 by Endpole Corporation, Cucamunga, Calif.

Each of the wire caps 41 is urged against the finger 154 of one of the armatures 132 by the spring 42, which is disposed within a recess 164 (see FIG. 23) in a rear end cap 165. The rear end cap 165 closes one end of a guide connector 166 as shown in FIG. 13.

The rear end cap 165 is retained at the end of the guide connector 166 through a potting compound 167, which is the same as the potting compound 59 of the wire matrix print head 10 of FIG. 1, adhering to a T-shaped portion 168 of the rear end cap 165 disposed within a cavity 169 in the guide connector 166. The cavity 169 is filled with the potting compound 167.

The guide connector 166 extends into a cavity 170 in a nose piece 171 through an opening 172 in an end wall 173 of the nose piece 171. The guide connector 166 has a reduced portion 174 forming a groove to enable the potting compound 167 in the cavity 170 to attach the guide connector 166 to the nose piece 171.

The nose piece 171 is mounted on an upstanding vertical support 176 of the stand 101 through an elongated arcuate sector 177 of the nose piece 171 extending through a circular shaped opening 178 in the support 176. Screws 179 (see FIG. 24) secure the nose piece 171 to the support 176 of the stand 101.

Each of the print wires 46 (see FIG. 13), which is activated by energization of one of the electromagnetic means 114, extends through a passage 180 (see FIG. 23) in the rear end cap 165 from the recess 164. Each of the passages 180 communicates with a passage 181 (see FIG. 13) in the potting compound 167 with the passages 181 being formed in the potting compound 167 in the same manner as described for the wire matrix print head 10 of FIG. 1 except that guide wires having a diameter of 0.010" ($2.54\times10^{-2}$ cm) are used.

Thus, when one of the coils 128 (see FIG. 13) of one of the electromagnetic means 114 is energized, the armature 132 pivots about the reduced portion 153 (see FIG. 19) to move the wire cap 41 (see FIG. 13) against the force of the spring 42. This movement of the wire cap 41 causes the connected print wire 46 to engage the ribbon 50 (see FIG. 1) to urge it against the recording medium 51 to cause printing thereon in a manner similar to that described for the wire matrix print head 10.

Each of the electromagnetic means 113 (see FIG. 13) is similar to each of the electromagnetic means 114 but has the U-shaped yoke 115 mounted on the front mounting plate 102 through being disposed in a recess 182 (see FIG. 14) in the front mounting plate 102. As previously mentioned, the longitudinal axis of each of the electromagnetic means 113 (see FIG. 13) is not aligned with the longitudinal axis of any of the electromagnetic means 114. This is accomplished through arranging four of the recesses 182 (see FIG. 14) at three, six, nine, and twelve o'clock positions of the front mounting plate 102 and the remainder of the recesses 182 every 30° therebetween while having the recesses 131 (see FIG. 15) in the rear mounting plate 108 with none of the recesses 131 at the three, six, nine, and twelve o'clock positions but disposed 15° on each side thereof with the other of the recesses 131 spaced 30° therefrom. The angular displacement is with respect to the center of each of the mounting plates 102 (see FIG. 14) and 108 (see FIG. 15) with the radii forming the center lines of the recesses 182 (see FIG. 14) and 131 (see FIG. 15), respectively.

The rear end wall 173 (see FIG. 25) of the nose piece 171 has a plurality of equally angularly spaced recesses 183 about the circumference of a circle. Each of the recesses 183 receives one of the springs 42 (see FIG. 13), which biases one of the wire caps 41 against one of the armatures 132, of the electromagnetic means 113.

Each of the armatures 132 of the electromagnetic means 113 has the finger 154 (see FIG. 19) disposed between the wire cap 41 (see FIG. 13) and one of the set screws 155, which are mounted in another of the retainer plates 156 that is mounted on the front mounting plate 102. The front mounting plate 102 has holes 185 (see FIG. 14) to receive the screws 160 (see FIG. 13) to connect the ears 157 (see FIG. 22) of the reatiner plate 156 thereon. Thus, the holes 185 (see FIG. 14) are positioned relative to the recesses 182 so that the set screws 155 (see FIG. 13) will be correctly positioned with respect to the wire caps 41.

Each of the wires 46, which is activated by one of the electromagnetic means 113, extends from the recess 183 (see FIG. 25) in the rear end wall 173 of the nose piece 171 through a passage 187 in the rear end wall 173 of the nose piece 171 into one of the passages 181 (see FIG. 13) in the potting compound 167, which is within the cavity 170 in the nose piece 171. Thus, each of the wires 46, which is activated by one of the electromagnetic means 113, is guided by one of the passages 181 in the potting compound 167.

The nose piece 171 has a front wall 188 with a plurality of passages 189 therein providing communication from the cavity 170 to the exterior of the front of the nose piece 171. Thus, the passages 189 enable each of the print wires 46 to pass from one of the passages 181 in the potting compound 167 to the exterior of the nose piece 171 to engage the ribbon 50 (see FIG. 1) when one of the electromagnetic means 113 (see FIG. 13) and 114, which activates the print wire 46, is activated to cause this movement.

The passages 189 in the front wall 188 of the nose piece 171 are arranged as shown in FIG. 26, and this is in the same manner as the passages 72 (see FIG. 10) in the front wall 71 of the nose piece 56. Thus, there are three columns of the passages 189 (see FIG. 26) with each having eight of the passages 189 and the passages 189 in each of the columns being staggered or offset relative to the passages 189 in the adjacent column.

After each of the wires 46 (see FIG. 13) exits from the passage 189 (see FIG. 26) in the front wall 188 of the nose piece 171, each of the wires 46 (see FIG. 13) passes through an aligned passage 190 in a first head guide 191, which is a relatively thin metal plate, and an aligned passage 192 in a second head guide 193, which is a relatively thicker metal block. The head guides 191 and 193 are secured to the nose piece 171 by screws 194, which extend through passages 195 in the guide 193 and passages 196 in the guide 191 into threaded holes 197 (see FIG. 24) in the front wall 188 of the nose piece 171.

It should be understood that the ribbon 50 (see FIG. 1) is not guided by any structure of the wire matrix print head 100 (see FIG. 13) as it was guided in the wire matrix print head 10 (see FIG. 1). Instead, the ribbon 50 has its own separate guides (not shown).

While there have been shown only two groups or packs of the electromagnetic means 18 (see FIG. 1) and 19 in the wire matrix print head 10 and two groups or packs of the electromagnetic means 113 (see FIG. 13) and 114 in the wire matrix print head 100, it should be understood that more than two of the groups could be employed if desired. However, this would increase the length of the wires 46 so that the wires 46 would require more input energy to drive them due to friction and increased mass whereby the speed of printing would be decreased.

While the wire matrix print head 10 (see FIG. 1) or 100 (see FIG. 13) has been described as moving relative to the recording medium 51 (see FIG. 1), it should be understood that the wire matrix print head 10 or 100 (see FIG. 13) could be stationary and the recording medium 51 (see FIG. 1) moved relative thereto in the pass direction. Therefore, there can be movement of either of the wire matrix print head 10 or 100 (see FIG. 13) or movement of the recording medium 51 (see FIG. 1) to produce printing.

While the wire matrix print head 10 has been shown and described as having the electromagnetic means 18 and 19 for activating the wires 46 and the wire matrix print head 100 (see FIG. 13) has been shown and described as having the electromagnetic means 113 and 114 for actuating the wires 46, it should be understood that any magnetic means capable of selective activation can be employed to activate the wires 46. Therefore, any other suitable magnetic means may be employed.

An advantage of this invention is that the mass of the print wires of a wire matrix print head is reduced. Another advantage of this invention is that the moment of inertia of a wire matrix print head having a relatively large number of electromagnetic means is decreased. A further advantage of this invention is that extensive bending of the print wires of a wire matrix print head is eliminated while still having a relatively large number of the print wires close to each other for producing high quality print. Still another advantage of this invention is that a high quality print is obtained from a wire matrix print head in a single pass relative to a recording medium.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A wire matrix print head comprising:

a first group of wires;

a second group of wires;

first guide means having said first group of wires and said second group of wires extending therethrough and supported thereby for guiding each of said wires of said first and second groups;

a first group of a plurality of magnetic means, each of said magnetic means of said first group causing activation of one of said wires of said first group to cause printing by said activated wire;

first mounting means to mount said magnetic means of said first group on the circumference of a circle and substantially equally angularly spaced from each other;

a second group of a plurality of magnetic means disposed further from the printing ends of said wires of said first and second groups than said magnetic means of said first group, each of said magnetic means of said second group causing activation of one of said wires of said second group to cause printing by said activated wire;

second mounting means to mount said magnetic means of said second group on the circumference of a circle and substantially equally angularly spaced from each other;

each of said magnetic means of said second group has its longitudinal axis out of alignment with the longitudinal axis of each of said magnetic means of said first group;

second guide means to guide only each of said wires of said second group between the activating end of each of said wires of said second group and said first guide means;

each of said wires of said first group having its end adjacent said magnetic means of said first group disposed on the circumference of a circle;

each of said wires of said second group having its end adjacent said magnetic means of said second group disposed on the circumference of a circle;

each of said magnetic means of said first group and said second group including:

a coil;

and a pivotally mounted arm having one end extending inwardly towards the center of the circle on which said magnetic means are disposed;

said one end of each of said arms of said magnetic means of said first group being disposed on the circumference of a circle so as to cause movement of one of said wires of said first group when said arm is moved by energization of said coil;

said one end of each of said arms of said magnetic means of said second group being disposed on the circumference of a circle to cause movement of one of said wires of said second group when said arm is moved by energization of said coil;

separate resilient means acting on each of said wires of said first and second groups to urge each of said wires to a non-print position in which each of said wires contacts said corresponding arm without being connected thereto so that each of said wires can be moved by activation of said corresponding arm by said corresponding coil, each of said separate resilient means returning said corresponding arm to its inactive position when said corresponding coil is deenergized to return said corresponding wire to its non-print position;

said first guide means including:

an elongated housing having a first set of passages and a second set of passages extending therethrough;

each passage of said first set of passages supporting one of said wires of said first group;

each passage of said second set of passages supporting one of said wires of said second group;

and said first set of passages terminating in a circle at their ends remote from the printing ends of said wires;

said second guide means including:

an elongated housing having a set of passages extending therethrough supporting each of said wires of said second group;

and said set of passages terminating in a circle at their ends remote from the printing ends of said wires;

said housing of said first guide means having an opening at its end remote from the printing ends of said wires and of smaller diameter than the diameter of the circle in which said first set of passages terminates;

said housing of said second guide means having a portion extending into said housing of said first guide means through said opening in said housing of said first guide means for support by said housing of said first guide means;

said set of passages of said housing of said second guide means being continuous with said second set of passages of said housing of said first guide means and supporting said wires of said second group from adjacent said magnetic means of said second group to said second set of passages of said housing of said first guide means;

said first and second sets of passages of said housing of said first guide means and said set of passages of said housing of said second guide means cooperating to change the relation of said wires of said first and second groups from a circular configuration at their activating ends to a matrix of rows and columns at their printing ends with each of said wires being spaced from all of the other of said wires throughout its length;

said housing of said first guide means supporting each of said separate resilient means acting on each of said wires of said first group to maintain each of said wires of said first group in contact with said corresponding arm when said wire is in its non-print position;

and said housing of said second guide means supporting each of said separate resilient means acting on each of said wires of said second group to maintain each of said wires of said second group in contact with said corresponding arm when said wire is in its non-print position.

2. The wire matrix print head according to claim 1 including:

each of said wires having an enlarged end at its activating end;

each of said separate resilient means engaging the enlarged end of one of said wires to act on said wire;

said housing of said first guide means having recesses therein surrounding one end of each of said passages of said first set of passages;

each of said separate resilient means acting on each of said wires of said first group being disposed within one of said recesses in said housing of said first guide means and surrounding said wire extending through said recess and said passage;

said housing of said second guide means having recesses therein surrounding one end of each passage of said set of passages therein;

and each of said separate resilient means acting on each of said wires of said second group being disposed within one of said recesses in said housing of said second guide means and surrounding said wire extending through said passage and said recess.

3. The wire matrix print head according to claim 2 in which:

said first mounting means supports separate dampening means to engage each of said arms of said magnetic means of said first group, each of said separate dampening means functioning as a return damper when said corresponding coil is deenergized and being adjustably positioned on said first mounting means;

and said second mounting means supports separate dampening means to engage each of said arms of said magnetic means of said second group, each of said separate dampening means functioning as a return damper when said corresponding coil is deenergized and being adjustably positioned on said second mounting means.

4. The wire matrix print head according to claim 1 in which:

said housing of said first guide means has a potting compound therein, said potting compound has said first set of passages and said second set of passages formed therein;

said housing of said second guide means has a potting compound therein, and said potting compound in said housing of said second guide means has said set of passages supporting each of said wires of said second group formed therein;

and said housing of said second guide means has a groove formed in said portion extending into said housing of said first guide means through said opening in said housing of said first guide means to enable said potting compound in said housing of said first guide means to attach said housing of said second guide means to said housing of said first guide means for support thereby.

* * * * *